US008528122B2

(12) United States Patent
Ball et al.

(10) Patent No.: US 8,528,122 B2
(45) Date of Patent: Sep. 10, 2013

(54) DRAIN CLOSURE DEVICE

(75) Inventors: William T. Ball, Colorado Springs, CO (US); Eric Pilarczyk, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 925 days.

(21) Appl. No.: 12/649,717

(22) Filed: Dec. 30, 2009

(65) Prior Publication Data

US 2011/0154563 A1 Jun. 30, 2011

(51) Int. Cl.
*A47K 1/14* (2006.01)

(52) U.S. Cl.
USPC ..... 4/293

(58) Field of Classification Search
USPC ..... 4/293, 286–295
See application file for complete search history.

(56) References Cited

U.S. PATENT DOCUMENTS

| | | | |
|---|---|---|---|
| 729,360 | A | 5/1903 | Kosiol |
| 1,760,659 | A | 5/1930 | Passman |
| 2,197,083 | A | 4/1940 | Schaible |
| 2,662,230 | A | 12/1953 | Borman |
| 2,915,762 | A | 12/1959 | Kivela |
| 3,314,085 | A | 4/1967 | Minelli |
| 3,366,980 | A | 2/1968 | Petursson et al. |
| 3,428,295 | A | 2/1969 | Downey et al. |
| 3,800,339 | A | 4/1974 | Bergin |
| 4,006,498 | A | 2/1977 | Cuschera |
| 4,007,500 | A | 2/1977 | Thompson et al. |
| 4,146,939 | A | 4/1979 | Izzi |
| 4,339,832 | A | 7/1982 | Cischera |
| 4,369,531 | A | 1/1983 | Swanson |
| 4,420,844 | A | 12/1983 | Puckett et al. |
| 4,457,030 | A | 7/1984 | Burry |
| 4,720,877 | A | 1/1988 | Watts |
| 4,908,883 | A | 3/1990 | Rivera |
| 4,926,507 | A | 5/1990 | Craig et al. |
| 5,072,461 | A | 12/1991 | Logsdon |
| 5,363,518 | A | 11/1994 | Mowery |
| 5,428,847 | A | 7/1995 | Atkins et al. |
| 5,692,248 | A | 12/1997 | Ball |
| 5,749,105 | A | 5/1998 | Bruno et al. |
| 5,758,368 | A | 6/1998 | Ball |
| 5,832,545 | A | 11/1998 | Pan |
| 5,881,397 | A | 3/1999 | Hobbs |
| 6,066,119 | A | 5/2000 | Ball |
| 6,067,669 | A | 5/2000 | Peterson et al. |
| 6,138,290 | A | 10/2000 | Lin |
| 6,148,454 | A | 11/2000 | Ball |
| 6,154,898 | A | 12/2000 | Ball |
| 6,173,459 | B1 | 1/2001 | Ball |
| 6,226,806 | B1 | 5/2001 | Ball |

(Continued)

FOREIGN PATENT DOCUMENTS

| | | |
|---|---|---|
| IT | 525399 | 5/1955 |

*Primary Examiner* — Lori Baker
(74) *Attorney, Agent, or Firm* — Sheridan Ross P.C.

(57) ABSTRACT

A drain closure device that allows a user to selectively open or close the drain closure device to permit or restrict the flow of water therethrough. The drain closure is comprised of a strainer body which houses an insert. The insert has a plurality of openings. A cap is mounted to the insert that has a plurality of openings, which upon rotation of the cap relative to the insert selectively align with the openings on the insert to allow fluid flow from a tub or sink.

22 Claims, 4 Drawing Sheets

(56) References Cited

U.S. PATENT DOCUMENTS

| | | | | |
|---|---|---|---|---|
| 6,317,906 | B1 | 11/2001 | Ball | |
| 6,363,544 | B1 | 4/2002 | Ryan | |
| 6,418,570 | B1 | 7/2002 | Ball | |
| 6,490,739 | B1 * | 12/2002 | Lee | 4/293 |
| 6,546,573 | B1 | 4/2003 | Ball | |
| 6,640,358 | B2 | 11/2003 | Ball | |
| 6,691,411 | B2 | 2/2004 | Ball | |
| 6,880,179 | B2 | 4/2005 | Wang | |
| 7,503,083 | B2 | 3/2009 | Ball | |
| 2008/0098517 | A1 | 5/2008 | Ball | |

* cited by examiner

DRAIN CLOSURE DEVICE

FIELD OF THE INVENTION

Embodiments of the present invention are related to drain closure devices, and more specifically, a drain closure device that selectively rotates between an open position and a closed position that may be installed into an existing strainer body.

BACKGROUND OF THE INVENTION

Drain closure devices for receptacles such as bathtubs, basins, sinks or other basins that selectively store a liquid, such as water, are well known in the art and come in a variety of shapes, sizes and configurations. As an example, some drain closures are mechanically operated by flipping a trip lever, while others are operated by a knob on the closure device. Over time the prior art closure devices will wear and eventually break, requiring repair or replacement. Further, the damaged components of the drain closure may cause leakage.

For example, U.S. Pat. No. 6,363,544 entitled "Spring Biased Drain Closure", which issued on Apr. 2, 2002, and which is incorporated by reference herein, discloses a drain closure comprising a helical spring positioned beneath the cap, that functions to bias a plug away from a strainer to allow fluid to escape. This closure device further comprises a number of mechanical components to maintain the plug in a closed position, such as bayonet pins, that are easily damaged.

Further, U.S. Pat. No. 6,880,179 entitled "Sink Stopper" which issued on Apr. 19, 2005, discloses an alternative closure device comprising a spring-biased press cap that is associated with a seal ring that is employed to selectively open and seal a drain. The press cap includes a groove, or cam, that cooperates with a pin to maintain the cap in an open or closed position. The pins of this device are apt to break, the spring may wear, and/or the seal ring may wear and fail.

Thus, there exists a need in the art for a drain closure device that addresses the above-identified and other needs understood by those skilled in the art. The following describes a drain closure that addresses the drawbacks of the prior art and that is easy to install and operate in a conventional bathtub or similar basin.

SUMMARY OF THE INVENTION

It is one aspect of the present invention to provide a drain closure assembly that allows for fluid to selectively pass therethrough. More specifically, one embodiment of the present invention includes a cap that is rotatably interconnected to an insert, wherein the insert is directly interconnected to a strainer body that is traditionally positioned in a drain. The cap of one embodiment includes at least one aperture therethrough. Similarly, the insert includes at least one aperture. In operation, when the cap aperture is aligned with an aperture integrated into a top portion of the insert, a flow path is created such that fluid above the drain closure device is able to flow into a waste water plumbing system of a dwelling. In addition, it is envisioned that slots may be integrated into the cap and/or insert to allow for greater amounts of fluid to be transferred from a bathtub into the waste water plumbing system. Further, it is contemplated that the slots and apertures provided include a sealing member about a peripheral edge thereof that helps prevent drainage of contained fluid when the apertures and/or slots are not aligned.

It is another aspect of the present invention to provide a drain closure device that is easy to install. The closure device of embodiments of the present invention is easily interconnected to strainer bodies commonly used. Further, it is one advantage of the present invention that the cap may be removed from the insert and discarded if there is damage to the finish or structure thereof. Thereafter, a replacement cap may be rotatably interconnected to the insert that remains interconnected to the strainer body.

It is also another aspect of the present invention to provide a drain closure device that can be easily scaled in size to fit sinks, bathtubs etc. Further, one skilled in the art will appreciate that a cap of any shape, i.e., circular, square, diamond, hexagonal etc. is contemplated. In addition, although rotation of the cap relative to the insert is described herein, one skilled in the art will appreciate that any relative motion between the cap and the insert is contemplated. For example, a cap that is either pulled upwardly or pushed downwardly relative to the insert such that apertures and/or slots align to provide a fluid path is within the scope of the invention. A cap that slides relative to the insert may also be used.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

BRIEF DESCRIPTION OF DRAWINGS

The accompanying drawings, which are incorporated in and constitute a part of the specification, illustrate embodiments of the invention and together with the general description of the invention given above and the detailed description of the drawings given below, serve to explain the principles of these embodiments.

Figure 1:
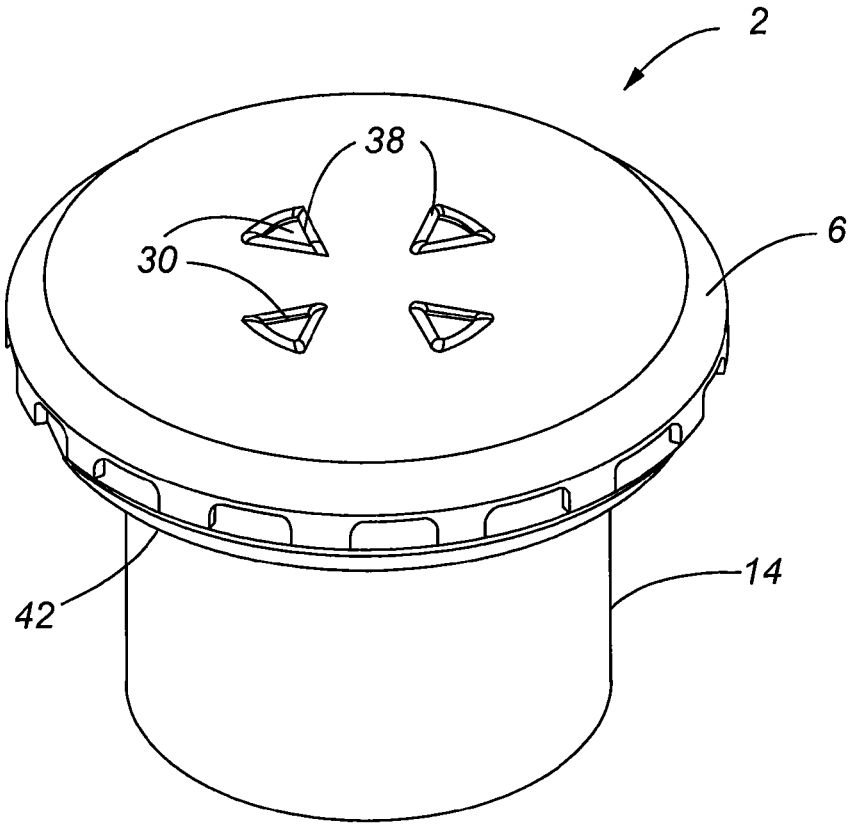
FIG. 1 is a top perspective view of the drain closure of one embodiment of the present invention.

To provide further clarity to the detailed description provided herein in the associated drawings, the following list of components and associated numbering are provided as follows:

| # | Component |
|---|---|
| 2 | Drain Closure Device |
| 6 | Cap |
| 10 | Insert |
| 14 | Strainer Body |
| 18 | Tee |
| 22 | Horizontal Overflow Pipe |
| 26 | Elbow |
| 30 | Cap Apertures |
| 34 | Insert Apertures |
| 38 | Sealing Members |
| 42 | Strainer Flange |
| 46 | Top Plate |
| 54 | Insert Sidewall |
| 58 | Bottom Surface |
| 60 | Insert Slots |
| 62 | Stem |
| 66 | Flange |
| 70 | Bathtub |
| 74 | Drain Port |
| 78 | Bottom Surface of Bathtub |
| 82 | Hub |
| 86 | Threaded Bore |
| 90 | Threaded Portion |
| 94 | Seal |
| 98 | Cap Top Surface |
| 102 | Cap Slots |
| 106 | Cap Sidewall |
| 110 | Rim |
| 114 | Elongated sidewall |
| 118 | Groove |
| 122 | Seal |
| 126 | Fluid |

DETAILED DESCRIPTION

Referring now to FIGS. 1-6, a drain closure device 2 is shown that includes a cap 6 that is interconnected to an insert 10. The insert 10 is designed to interconnect to a strainer body 14 commonly found in drain closure assemblies. The strainer body 14 is associated with a tee 18 or elbow (hereinafter "tee") that is in turn interconnected to a horizontal overflow pipe 22 (or horizontal drain pipe, whatever the case may be). The cap 6 and the insert 10 include a series of apertures 30 & 34 that allow water to flow into the tee 18 when the cap 6 is rotated relative to the insert 10 to align the apertures 30 & 34.

Referring now specifically to FIG. 1, the drain closure device 2 of one embodiment is shown that includes the cap 6 having a plurality of apertures 30. Preferably, one embodiment of the present invention also employs sealing members 38 positioned about a peripheral edge of each aperture 30. The cap 6 is associated with the strainer body 14, which includes a flange 42 that cooperates with the tee 18 to secure the bathtub (not shown) therebetween.

Figure 2:
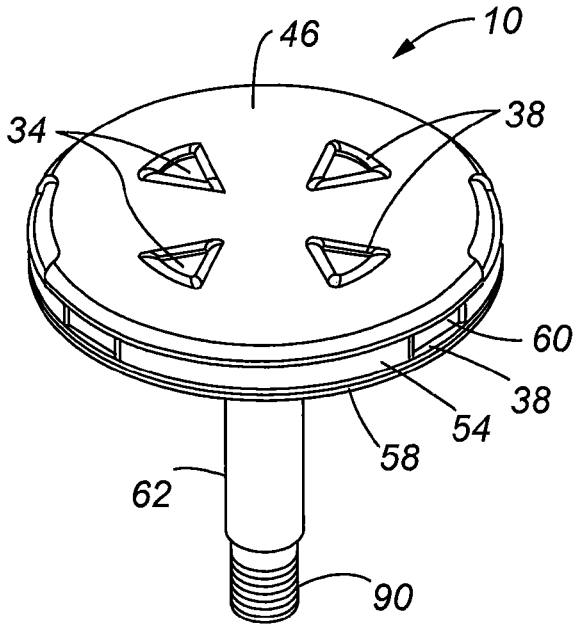
FIG. 2 is a top perspective view of an insert of one embodiment of the present invention.

Referring now to FIG. 2, the insert 10 of one embodiment of the present invention is shown which includes a top plate 46 having a plurality of apertures 34 integrated therethrough. One embodiment of the present invention may employ a sealing member 38 integrated about a peripheral edge of each aperture 34. A sidewall 54 extends from the edge of the top plate 46 which includes a plurality of slots 60, each preferably including sealing members 50 integrated around a peripheral edge thereof. The sidewall 54 terminates at a bottom surface 58. A stem 62, which is at least partially threaded in one embodiment, protrudes generally from the center of the top plate 46.

Figure 3:
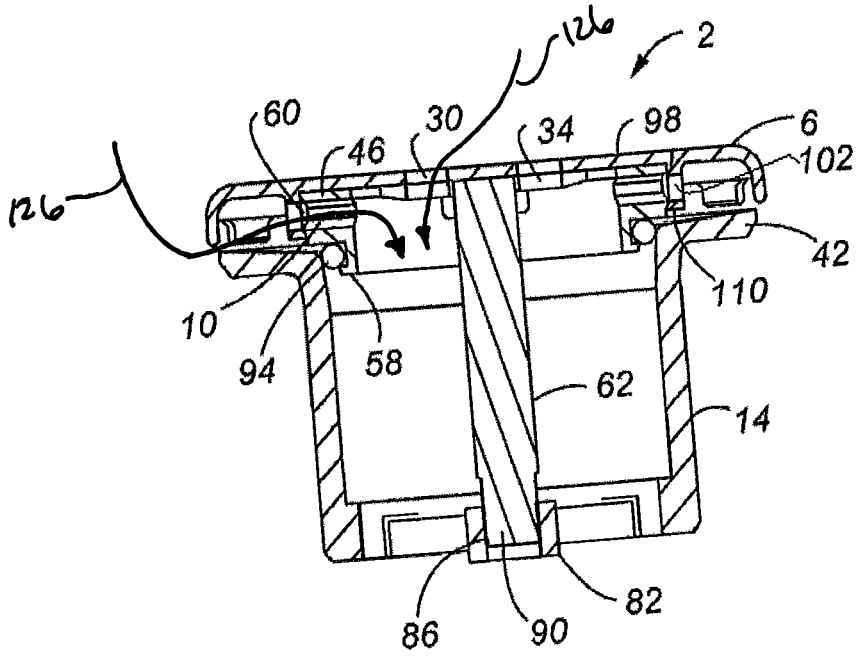
FIG. 3 is a sectional view of the drain closure shown in FIG. 1.
Figure 4:
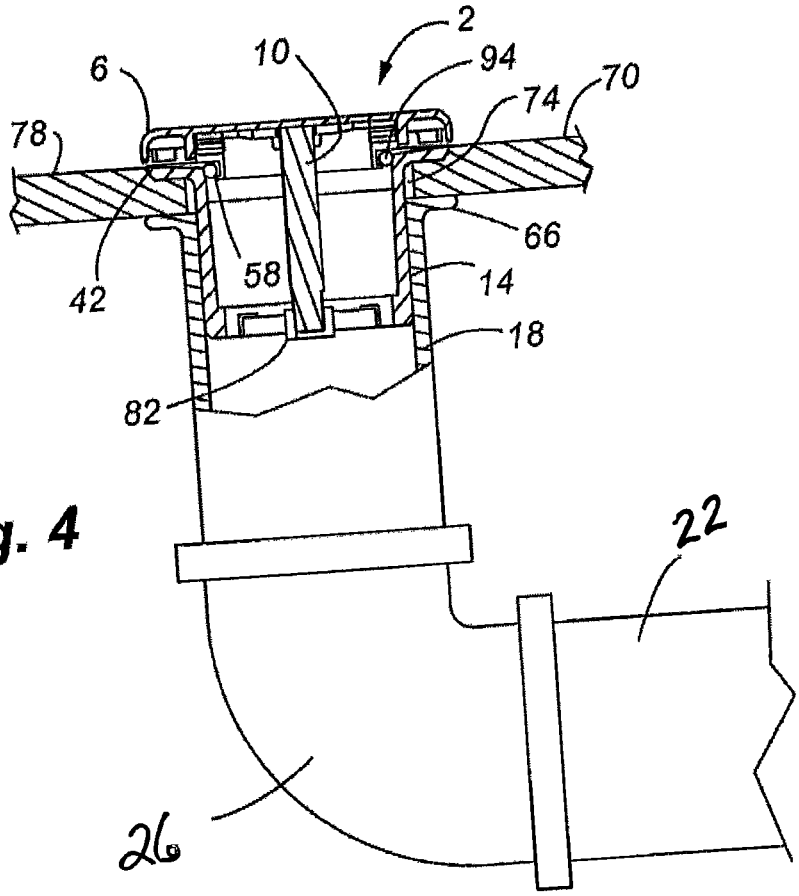
FIG. 4 is a partial sectional view of a drain closure according to one embodiment of the invention installed to a bathtub and interconnected to a waste water pipe.

Referring now to FIGS. 3 & 4, a cross sectional view of the drain closure device 2 is shown associated with the strainer body 14 commonly integrated into bathtubs, sinks, etc. The strainer body 14 includes the flange 42 that interfaces with a flange 66 of the tee 18 to secure the tee 18 to the bathtub 70. In operation, the strainer body 14 is inserted through the drain port 74 and placed adjacent to a bottom surface 78 of the bathtub 70. The strainer body 14 may be threadingly engaged to the tee 18 or otherwise interconnected thereto. The insert 10 is then interconnected (threadingly or clipped, for example) to a hub 82 of the insert 10 via a threaded bore 86. Alternatively, the insert 10 may be interconnected to the cross members associated with the hub 82. Preferably, the insert 10 of one embodiment includes a stem 62 with a threaded portion 90 that selectively engages the threaded portion 86 of the hub 82. A seal 94 is located between the insert 10 and the inner surface of the strainer body 14.

The cap 6 is placed on the insert 10 wherein the top plate 46 of the insert 10 engages a top surface 98 of the cap 6. In one embodiment, the insert 10 and the cap 6 include a plurality of apertures 34 and 30 that are adapted to be selectively aligned by movement of the cap 6 relative to the insert 10. Preferably, the movement comprises manual or electromechanically actuated rotation of the cap 6 relative to the insert 10. Further, the insert 10 may also rotate wherein the cap 6 is fixed, to the bottom surface of the bathtub, for example. In addition, the cap 6 includes slots 102 that are selectively aligned with slots 60 of the insert 10. As shown in FIG. 3, when aligned, a fluid path is opened through the apertures 30 and 34 and into the strainer body 14, which transfers fluid 126 from the bathtub 70 into the tee 18. Further, when properly aligned, the slots 102 of the cap 6 and the slots 60 of the insert 10 to allow fluid to flow therethrough. The cap 6 of one embodiment has a non-continuous outer surface that facilitates transfer of fluid to the slots 60 thereof. The apertures 30 and 34 also include sealing members 38 positioned about an edge thereof. When the apertures 30 and 34 are not aligned, the sealing member 38 prevents fluid flow. More specifically, the apertures 30 located on the cap 6 will be sealingly blocked by the top plate 46 of the insert 10 and the sealing members 38. Similarly, the slots 60 and 102 may also include similarly arranged sealing members 38. When slots 102 and 60 are not aligned, the sealing members 38 are place adjacent to the sidewall 106 of the cap 6 which prevents flow of liquid therethrough. Although rotation of the cap 6 relative to the insert 10 is shown, one of skill in the art will appreciate that the cap 6 may be slid, either longitudinally or transverse, relative to the insert 10 to create a fluid flow path. Furthermore, the teachings provided by embodiments of the present invention can be combined with the closure devices of the prior art referred to above.

The cap 6 is preferably snap fit onto the insert 10 wherein the sidewall 106 of the cap 6 is placed over the sidewall 54 of the insert 10. The sidewall 106 of the cap 6 may have a rim 110 with a decreased inner radius that interfaces with the bottom surface 58 of the insert 10 to prevent the cap 6 from being easily removed from the insert 10.

Figure 5:
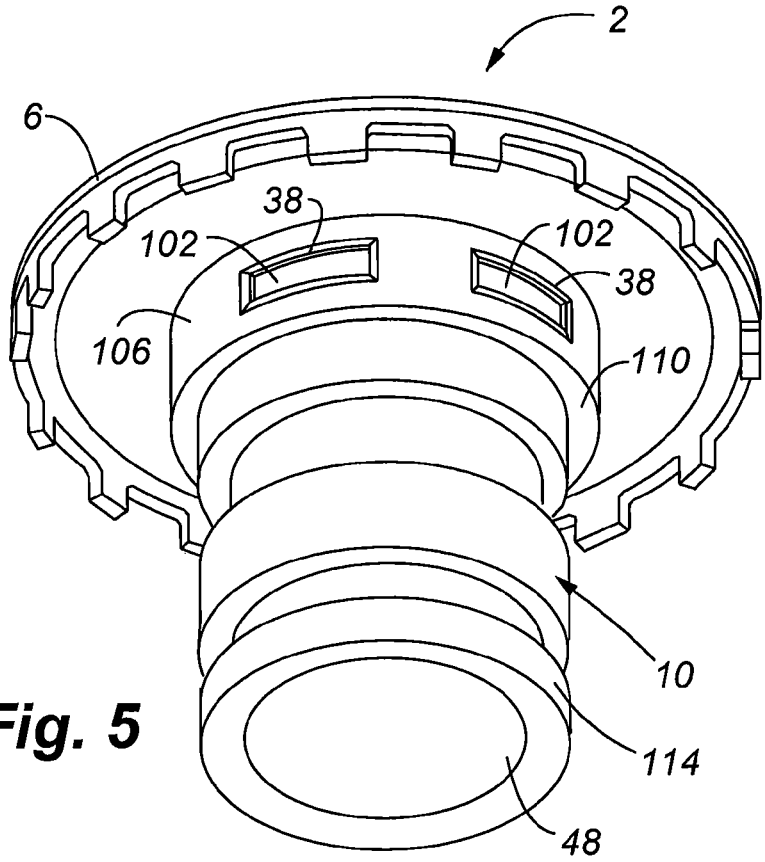
FIG. 5 is a bottom perspective view of the drain closure of another embodiment of the present invention.
Figure 6:
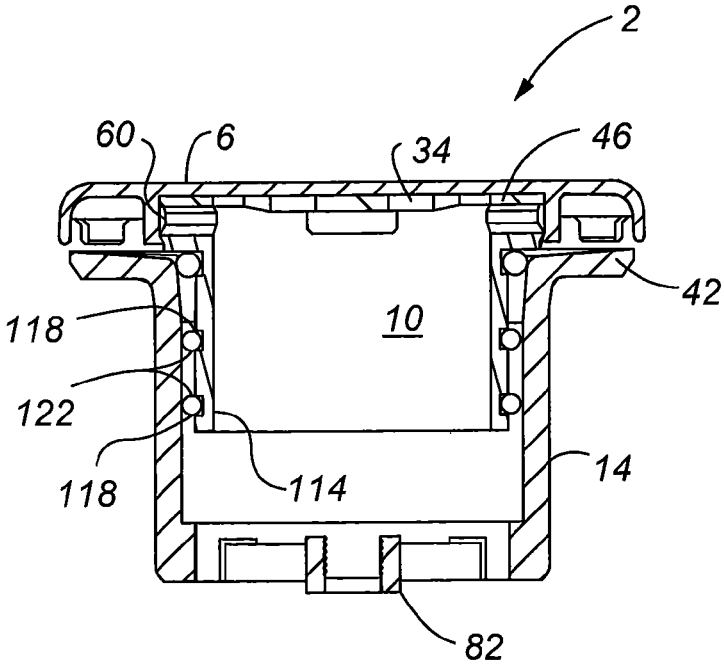
FIG. 6 is a sectional view of a drain closure of the embodiment shown in FIG. 5.

Referring now to FIGS. 5 and 6, an alternative embodiment of the present invention is shown. Here, the insert 10 includes elongated sidewall 114, with at least one groove 118 for the receipt of at least one seal 122. The seals 122 prevent a flow path from the bathtub 70 directly into the strainer body 14, which would circumvent the drain closure 2. This embodiment of the present invention also includes a plurality of slots 102 and 46 that are selectively aligned to allow fluid flow into the tee. The elongated sidewall 114 (shown) does not include a threadable portion for interconnection to the hub of the strainer body 14. One of skill in the art, however, will appreciate that the elongated sidewall 114 may be threadingly associated with the strainer body 14. This embodiment of the invention allows the selective flow of fluid similar to that shown in FIG. 3.

Components of embodiments of the present invention are made of materials commonly used in the plumbing arts. More specifically, the insert 10 may be made of a plastic or metallic material that interfaces with the threads of the strainer body 14. The cap 6 and the insert 10 may be made of, or coated with plastic, chrome, nickel, brass, aluminum or any other material commonly used. The sealing members 38 may be made of resilient materials such as neoprene or rubber. Further, although a combination of apertures and slots are shown and described herein, one of skill in the art will appreciate that embodiments may employ apertures or slots alone.

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the present invention. For example, aspects of the inventions disclosed in U.S. patent application Ser. No. 11/931,681, filed Oct. 31, 2007, which was published in U.S. Patent Application Publication No. 2008/0098517, which is incorporated herein by reference in its entirety herein, may be added to the present invention. Further, U.S. Pat. Nos. 6,148,454, 6,154,898, 6,317,906, 6,173,459, 6,640,358, 6,418,570, 6,691,411, 6,546,573 and 7,503,083, the disclosures of which are incorporated by reference herein, are related to the embodiments of the invention disclosed herein. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the appended claims be construed to include alternative embodiments to the extent permitted by the prior art.

What is claimed is:

1. A drain closure device, comprising:

a) an insert for interconnection to a strainer body, said insert comprising:

i) a cylindrically shaped body defined by an upper planar surface with a first plurality of apertures therethrough, ii) a sidewall extending from said upper planar surface that includes a first plurality of slots therethrough, and iii) an elongated stem extending from said upper planar surface that is selectively interconnected to the strainer body;

b) a cap for operable association with said insert, said cap comprising:

i) an upper planar surface with a second plurality of apertures therethrough, ii) a sidewall extending from said upper planar surface of said cap that includes a second plurality of slots therethrough; and wherein alignment of at least one of one of said first plurality of apertures and one of said second plurality apertures and one of said first plurality of slots and said second plurality of slots, creates a fluid path that allows fluid to flow from a point above said cap to a point below said insert.

2. The device of claim 1, wherein said insert is interconnected to said cap with a seal therebetween.

3. The device of claim 1, wherein said drain closure includes a hub that treadingly receives said stem.

4. The device of claim 1, wherein said stem includes a first outer diameter that is generally equal to an inner diameter of the drain closure and a second outer diameter that is less than said first diameter.

5. The device of claim 1, wherein said first plurality of apertures and said second plurality of apertures possess a generally triangular shape.

6. The device of claim 1, wherein said first plurality of slots and said second plurality of slots possess a generally rectangular shape.

7. The device of claim 1, wherein said first plurality of slots, said second plurality of slots, said first plurality of apertures and said second plurality of apertures are each defined by a peripheral edge, and further comprising a seal associated to said peripheral edges.

8. The device of claim 1, wherein said cap includes a second sidewall positioned radially outwardly from said side wall.

9. The device of claim 8, wherein said second sidewall possesses a textured surface.

10. The device of claim 1, wherein said first plurality of apertures and said second plurality of apertures is four.

11. The device of claim 1, wherein said first plurality of slots and said second plurality of slots is four.

12. The device of claim 1, wherein said cap is rotatably associated with said insert.

13. The device of claim 1, wherein said cap is slidingly associated with said insert.

14. The device of claim 1, wherein said fluid path is comprised of a passage defined by a portion of an inner surface of one of said first plurality of apertures and a portion of an inner surface of one of said second plurality of apertures.

15. The device of claim 1, wherein said fluid path is comprised of a passage defined by a portion of an inner surface of one of said first plurality of slots and a portion of an inner surface of one of said second plurality of slots.

16. A drain closure device for association with a strainer body that is interconnected to a drain pipe with a surface of a bathtub positioned therebetween, comprising:

an insert for interconnection to the strainer body, said insert comprising:

a cylindrically shaped body defined by a surface with at least one aperture therethrough, a sidewall extending from said surface that includes at least one slot therethrough, and a stem extending from said surface that is selectively interconnected to the strainer body; and a cap for operable association with said insert, said cap comprising:

a surface with at least one aperture therethrough, a sidewall extending from said surface of said cap that includes at least one slot therethrough.

17. The device of claim 16, wherein said insert is interconnected to the strainer body with a seal therebetween.

18. The device of claim 16, wherein the strainer includes a hub that treadingly receives said stem.

19. The device of claim 16, wherein said stem includes a first outer diameter that is generally equal to an inner diameter of the strainer body and a second outer diameter that is less than said first diameter.

20. The device of claim 19, wherein said apertures and said slots are each defined by a peripheral edge, and further comprising a seal associated to said peripheral edges.

21. The device of claim 19, wherein said cap is rotatably associated with said insert, wherein alignment of said at least one aperture of said cap and said at least one aperture of said inset creates a fluid path that allows fluid to flow from a point above said cap to a point below said insert.

22. The device of claim 19, wherein said cap is rotatably associated with said insert, wherein alignment of said at least one slot of said cap and said at least one slot of said insert creates a fluid path that allows fluid to flow from a point above said cap to a point below said insert.

* * * * *